US008266193B2

(12) United States Patent
Fong et al.

(10) Patent No.: US 8,266,193 B2
(45) Date of Patent: Sep. 11, 2012

(54) REAL TIME UNIVERSAL DATE AND TIME CONVERSION

(75) Inventors: Nia W. Fong, San Francisco, CA (US); Jeffrey G. Komatsu, Kasson, MN (US); Jason S. Lee, Oronoco, MN (US); Manivannan Thavasi, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 1139 days.

(21) Appl. No.: 12/129,994

(22) Filed: May 30, 2008

(65) Prior Publication Data

US 2008/0301212 A1 Dec. 4, 2008

Related U.S. Application Data

(60) Provisional application No. 60/941,512, filed on Jun. 1, 2007.

(51) Int. Cl.
*G04F 11/00* (2006.01)

(52) U.S. Cl. ..... 708/112

(58) Field of Classification Search ..... 708/112
See application file for complete search history.

(56) References Cited

U.S. PATENT DOCUMENTS

| | | | | |
|---|---|---|---|---|
| 6,108,640 | A * | 8/2000 | Slotznick | 705/7.18 |
| 7,349,920 | B1 * | 3/2008 | Feinberg et al. | 1/1 |
| 7,702,651 | B1 * | 4/2010 | Dickey et al. | 368/29 |
| 7,707,496 | B1 * | 4/2010 | Moore et al. | 715/254 |

* cited by examiner

*Primary Examiner* — Tan V. Mai
(74) *Attorney, Agent, or Firm* — Martin & Associates LLC; Bret J. Petersen

(57) ABSTRACT

A method and system makes date-time conversions and complex date-time calculations between dates of different calendaring systems. The conversion method herein allows embedded, real-time conversion in computer applications and systems between multiple calendaring systems. A date of a first date-time format is converted to any date of a second date-time format after a transformation to a temporal reference or epoch date. The conversion method can be embedded into any code space to enable full date-time conversion abilities. The real-time conversion of the conversion method requires no conversion tables and no post-processing manipulation thus eliminating the need for individual programmers to re-create the same date cross reference tables, or post processing algorithms. The conversion method supports conversion between any two date-time formats including the various existing Gregorian conventions.

19 Claims, 12 Drawing Sheets

Y = Year
$L_Y$ = Length of Standard Year (Days)
$L_{YA}$ = Length of Leap Year period A (Days)
$L_{YB}$ = Length of Leap Year period B (Days)
$L_{Yx}$ = Length of Leap Year period X (Days)
$C_{LA}$ = Length of Cycle for Leap Year period A (Years)
$C_{LB}$ = Length of Cycle for Leap Year period B (Years)
$C_{LX}$ = Length of Cycle for Leap Year period X (Years)
$NC_{LA}$ = Number of Leap Years in Leap Cycle A
$NC_{LX}$ = Number of Leap Years in Leap Cycle X
M = Month #
$M_{L1}$ = Month Length 1 (Days)
$M_{LX}$ = Month Length X (Days)

$X_1$ = Shortest Period of Even Duration == mS (milliSeconds)
$X_2$ = Next shortest Period of Even Duration == S (Seconds)
$X_3$ = Next shortest Period of Even Duration == M (Minutes)
$X_4$ = Next shortest Period of Even Duration == H (Hours)
$X_5$ = Next shortest Period of Even Duration == D (Days)
$X_n$ = Longest Period of Even Duration

- Lengths of Periods of Even Duration and their values in the base implementation

$X_{L1}$ = Length of Duration 1 == 1 mS
$X_{L2}$ = Length of Duration 2 == 1000 mS
$X_{L3}$ = Length of Duration 3 == 60 S
$X_{L4}$ = Length of Duration 4 == 60 M
$X_{L5}$ = Length of Duration 5 == 24 H
$X_{Ln}$ = Length of Duration n

- Epoch Offsets

$O_1$ = Offset for Shortest Period of Even Duration (mS Correction, part of Time Zone Correction)
$O_2$ = Offset for Next Period of Even Duration (Sec Correction, part of Time Zone Correction)
$O_3$ = Offset for Next Period of Even Duration (Minute Correction, part of Time Zone Correction)
$O_4$ = Offset for Next Period of Even Duration (Hour Correction, Part of Time Zone Correction
$O_5$ = Offset for Longest Period of Even Duration (Day Correction)
$E_y$ = Year of Universal Epoch Start in This_Calendar
WEy Week Epoch for This_Calendar

FIG. 6

$$\overset{X_5}{\Bigg[} L_y\left(\overset{S.A.C}{(Y\text{-}1)} - E_{y(x)}\right) + L_{LA}\left[\frac{\overset{S.A.C}{(Y\text{-}1)} - E_{y(x)}}{C_{LA}}\right] + L_{LB}\left[\frac{\overset{S.A.C}{(Y\text{-}1)} - E_{y(x)}}{C_{LB}}\right] + L_{LC}\left[\frac{\overset{S.A.C}{(Y\text{-}1)} - E_{y(x)}}{C_{LC}}\right]$$

$$+ \sum_{M=1\,\text{->}X}^{M-1}\left(\overset{S.A.C}{M_{L1}\ldots M_{L(M-1)}}\right) - O_5 + X_5\Bigg] \cdot \left[X_{L5} \cdot X_{L4} \cdot X_{L3} \cdot X_{L2} \cdot X_{L1}\right] \overset{X_4}{+} \quad \cdot \quad \cdot \quad \cdot$$

$$\overset{X_3}{(X_3 - O_3)}(X_{L3} \cdot X_{L2} \cdot X_{L1}) + \overset{X_2}{(X_2 - O_2)}(X_{L2} \cdot X_{L1}) + \overset{X_1}{(X_1 - O_1)}\,(X_{L1}) = \theta_E \quad \text{(Offset from Epoch in mS)}$$

FIG. 7

DAYS IN STANDARD YEAR

LEAP YEAR CORRECTION FACTORS $$\left[365((Y-1)-1970)+1\left[\frac{(Y-1)-1970}{400}\right]+-1\left[\frac{(Y-1)-1970}{100}\right]+1\left[\frac{(Y-1)-1970}{4}\right]\right.$$

$$\left.+\sum_{M=1\to X}\left(M_{L1}\ldots M_{L(M-1)}\right)-O_5+X_5\right]\cdot\left[24\cdot60\cdot60\cdot1000\cdot1\right]+(X_4)(60\cdot60\cdot1000\cdot1)$$

CHANGE 'DAYS' TO 'mS'

HOURS to mS

MINUTES OFFSET FROM EPOCH

SECONDS/mS OFFSET FROM EPOCH

Minutes to mS

Seconds to mS $$+(X_3)(60\cdot1000\cdot1)+(X_2)(1000\cdot1)+X_1(1)-T=\theta_E$$

(Offset from Epoch in mS)

TIME ZONE OFFSET FROM GMT

| Gregorian/ISO Constants: | | Variables: | |
|---|---|---|---|
| $L_{LA}$ | 1 Day | $X_1$ | mS |
| $L_{LB}$ | -1 Day | $X_2$ | S |
| $L_{LC}$ | 1 Day | $X_3$ | M |
| $C_{LA}$ | 400 years | $X_4$ | H |
| $C_{LB}$ | 100 years | $X_5$ | D |
| $C_{LB}$ | 4 years | $X_{L1}$ | 1mS |
| $E_{y(x)}$ | 1970 A.D | $X_{L2}$ | 1000 mS |
| | | $X_{L3}$ | 60 S |
| | | $X_{L4}$ | 60 M |
| | | $X_{L5}$ | 24H,Days |
| | | T | Time Zone Offset From GMT |

FIG. 8

$X_5$ DAYS IN STANDARD YEAR (S.A.C)

LEAP YEAR CORRECTION FACTORS (S.A.C)

$$365((Y-1)-178) + -1\left\lfloor\frac{(Y-1)-178}{4000}\right\rfloor + 1\left\lfloor\frac{(Y-1)-178}{400}\right\rfloor + -1\left\lfloor\frac{(Y-1)-178}{100}\right\rfloor + 1\left\lfloor\frac{(Y-1)-178}{4}\right\rfloor$$

$$+ \sum_{M=1 \to X}^{M-1} \left(M_{L1} \ldots M_{L(M-1)}\right) - O_5 + X_5 \Bigg] \cdot \Bigg[24 \cdot 60 \cdot 60 \cdot 1000 \cdot 1\Bigg] + (X_4 - O_4)(60 \cdot 60 \cdot 1000 \cdot 1)$$

(S.A.C) CHANGE 'DAYS' TO 'mS'; HOURS OFFSET FROM EPOCH ($X_4$); HOURS to mS

MINUTES OFFSET FROM EPOCH ($X_3$); Minutes to mS; SECONDS/mS OFFSET FROM EPOCH ($X_2$); Seconds to mS; ($X_1$); mS; mS $$+(X_3 - O_3)(60 \cdot 1000 \cdot 1) + (X_2 - O_2)(1000 \cdot 1) + (X_1 - O_1)(1) - T = \theta_E$$

(Offset from Epoch in mS)

TIME ZONE OFFSET FROM GMT

| French Republican Constants: | | Variables: | |
|---|---|---|---|
| $L_{LA}$ | -1 Day | $X_1$ | mS |
| $L_{LB}$ | 1 Day | $X_2$ | S |
| $L_{LC}$ | -1 Day | $X_3$ | M |
| $L_{LD}$ | 1 Day | $X_4$ | H |
| $C_{LA}$ | 4000 years | $X_5$ | D |
| $C_{LB}$ | 400 years | $X_{L1}$ | 1mS |
| $C_{LC}$ | 100 years | $X_{L2}$ | 1000 mS |
| $C_{LD}$ | 4 years | $X_{L3}$ | 60 S |
| $E_{y(x)}$ | | $X_{L4}$ | 60 M |
| | | $X_{L5}$ | ???5Hz? |

FIG. 9

1010

$$Z_{per\ A} \quad \left\lfloor \frac{\theta_{ED}}{(C_{LA} \cdot L_y) + (NC_{LA} \cdot L_{LA})} \right\rfloor$$

$$Z_{per\ B} \quad \left\lfloor \frac{R_A}{(C_{LB} \cdot L_y) + (NC_{LB} \cdot L_{LB})} \right\rfloor \quad \text{where} \quad R_A \quad \theta_{ED}\ \mathrm{MOD}\ (C_{LA})$$

$$Z_{per\ C} \quad \left\lfloor \frac{R_B}{(C_{LC} \cdot L_y) + (NC_{LC} \cdot L_{LC})} \right\rfloor \quad \text{where} \quad R_B \quad R_A\ \mathrm{MOD}\ (C_{LB})$$

$$Z_{per\ D} \quad \left\lfloor \frac{R_C}{(C_{LD} \cdot L_y) + (NC_{LD} \cdot L_{LD})} \right\rfloor \quad \text{where} \quad R_C \quad R_B\ \mathrm{MOD}\ (C_{LC})$$

FIG. 10

1110

$CX_1$ $\theta_E \text{ Mod } X_{L2} = R_{X_1}$ $$\frac{(\theta_E - R_{X_1})}{X_{L2}} = \theta_{EX_2}$$

$CX_2$ $\theta_{EX_2} \text{ Mod } X_{L3} = R_{X_2}$ $$\frac{(\theta_{EX_2} - R_{X_2})}{X_{L3}} = \theta_{EX_3}$$

$CX_3$ $\theta_{EX_3} \text{ Mod } X_{L4} = R_{X_3}$ $$\frac{(\theta_{EX_3} - R_{X_3})}{X_{L4}} = \theta_{EX_4}$$

$CX_4$ $\theta_{EX_4} \text{ Mod } X_{L5} = R_{X_4}$ $$\frac{(\theta_{EX_4} - R_{X_4})}{X_{L5}} = \theta_{EX_5} = \theta_{ED}$$

1120

$$\text{YEAR Y} = \frac{\overset{\text{Calendar with Fixed length year varied by multiple Leap Year Cycles}}{\theta_{ED}}}{(Z_{per\ A} \cdot C_{LA}) + (Z_{per\ B} \cdot C_{LB}) + (Z_{per\ C} \cdot C_{LC}) + (Z_{per\ D} \cdot C_{LD})}$$

$$\text{Day Remainder } R_{X_5} = \theta_{ED} \text{ MOD } [(Z_{per\ A} \cdot C_{LA}) + (Z_{per\ B} \cdot C_{LB}) + (Z_{per\ C} \cdot C_{LC}) + (Z_{per\ D} \cdot C_{LD})]$$

1130

FIG. 11

CX1 $\theta_E \text{ Mod } 1000 = R_{mS}$ MILLISECOND REMAINDER $$\frac{(\theta_E - R_{mS})}{1000} = \theta_{ES}$$ TOTAL SECONDS CX2 $\theta_{ES} \text{ Mod } 60 = R_S$ SECONDS REMAINDER $$\frac{(\theta_{ES} - R_S)}{60} = \theta_{EM}$$ TOTAL MINUTES CX3 $\theta_{EM} \text{ Mod } 60 = R_M$ MINUTES REMAINDER $$\frac{(\theta_{EM} - R_M)}{60} = \theta_{EH}$$ TOTAL HOURS CX4 $\theta_{EH} \text{ Mod } 24 = R_H$ HOURS REMAINDER $$\frac{(\theta_{EH} - R_H)}{24} = \theta_{ED}$$ TOTAL DAYS E.L.C. YEAR Y = Calendar with Fixed length year varied by multiple Leap Year Cycles $$\frac{\theta_{ED}}{(Z_{per\ A} \cdot 400) + (Z_{per\ B} \cdot 100) + (Z_{per\ C} \cdot 4) + (Z_{per\ D} \cdot 1)}$$

$$\theta_{ED} \text{ MOD } [(Z_{per\ A} \cdot 400) + (Z_{per\ B} \cdot 100) + (Z_{per\ C} \cdot 4) + (Z_{per\ D} \cdot 1)]$$

$$Z_{per\ A} = \left\lfloor \frac{\theta_{ED}}{(400 \cdot 365) + (97 \cdot 1)} \right\rfloor$$

$$R_A = \theta_{ED} \text{ MOD } (400)$$

$$Z_{per\ B} = \left\lfloor \frac{R_A}{(100 \cdot 365) + (24 \cdot -1)} \right\rfloor$$

$$R_B = R_A \text{ MOD } (100)$$

$$Z_{per\ C} = \left\lfloor \frac{R_B}{(4 \cdot 365) + (1 \cdot 1)} \right\rfloor$$

$$R_C = R_B \text{ MOD } (1)$$

$$Z_{per\ D} = \left\lfloor \frac{R_C}{(1 \cdot 365) + (0)} \right\rfloor$$

FIG. 12

REAL TIME UNIVERSAL DATE AND TIME CONVERSION

CROSS REFERENCE TO RELATED APPLICATION

This is a Non-provisional application of U.S. Patent Provisional Application Ser. No. 60/941,512, filed Jun. 1, 2007, entitled, "Real Time Embedded Universal Date/Time Conversion Algorithms", the entirety of which is hereby incorporated herein by reference.

BACKGROUND

1. Technical Field

The description and claims herein generally relate to date and time conversion, and more specifically relate to real time universal date and time conversion in a computer system.

2. Background Art

Many different date calendaring systems have been developed over the centuries. These date calendaring systems are typically based on a complex set of observations, algorithms, and conventions, which attempt to define a 'time' and 'date' according to the sun, moon, stars, or other bodies with respect to the earth and each other. The modern business world has largely accepted the Gregorian calendar (as adopted by ISO 8601 or other national/local conventions). However, even with this "standard," there are still important differences in each implementation of this calendar in business, financial, and civil applications. These differences create confusion and inaccuracies regarding data produced by or extracted from computer applications and computer systems using these date calendaring systems. In addition there are many other formats in use around the world. Thus many seemingly irreconcilable variations of calendaring systems have been promulgated over time, and many different calendaring systems are in use around the world today.

When developing computer programs, programmers must deal with these different calendar systems to share information between computers, applications and data stored with a different date system. In the past, the majority of programmers have attempted to reconcile the different calendaring systems by manual creation of a fixed translation table for each year and each conversion, with each table representing the specific conversion format desired (for instance, Date of Year for 2006 to ISO 8601 Week of Year for 2006). This involves error-prone manual work in the creation and loading of these conversion tables. Other attempts have used post-processing routines, either done manually or run automatically, to refine the extracted data to convert it to a date in the desired format, after the initial data gathering had been done. These prior attempts at date and time conversion are directed to a specific situation and thus limited to that situation and conversion. These prior methods are impractical for handling any long era or group of timeframes or other multiple calendar systems. Thus, there is currently no known way to reliably convert the date and time to a desired format during the runtime of an application or query, without resorting to fixed published conversion tables or the like. There is furthermore no way to change the date format requested, real-time, to accommodate changing or new date format needs as they arise.

Without a way to efficiently and in real time convert dates between different calendar systems, computer system development will continue to suffer from error prone and inefficient conversion of dates using conversion tables.

BRIEF SUMMARY

The specification and claims herein are directed to making date-time conversions and complex date-time calculations between dates of different calendaring systems. The conversion method herein allows embedded, real-time conversion in computer applications and systems between multiple calendaring systems. The conversion method utilizes extensible algorithms to make the date-time conversions. Using these extensible algorithms, any required date or time variation can be calculated when provided with specific requirements of a date-time format. A date of a first date-time format is converted to any date of a second date-time format after a transformation to a temporal reference or epoch date. The conversion method can be embedded into any code space to enable full date-time conversion abilities. The real-time conversion of the conversion method requires no conversion tables and no post-processing manipulation thus eliminating the need for individual programmers to re-create the same date cross reference tables, or post processing algorithms. The conversion method supports conversion between any two date-time formats including the various existing Gregorian conventions in use in the business world.

The foregoing and other features and advantages will be apparent from the following more particular description, and as illustrated in the accompanying drawings.

BRIEF DESCRIPTION OF DRAWINGS

The disclosure will be described in conjunction with the appended drawings, where like designations denote like elements, and:

FIG. 6 is a list of variable definitions used in the formulas in subsequent figures;

FIG. 7 is a generalized formula for conversion to an offset from a universal epoch from a Gregorian date;

FIG. 8 is formula with constants for conversion to an offset from a universal epoch from a Gregorian date;

FIG. 9 is a formula with constants for conversion to an offset from a universal epoch from a French Republican date;

FIG. 10 illustrates a set of adjustment factors for leap year that are part of the date-time parametric definition for a Gregorian calendar;

FIG. 11 is a generalized formula for conversion from a universal epoch offset to a Gregorian date; and FIG. 12 is a formula with constants for conversion from a universal epoch offset to a Gregorian date.

DETAILED DESCRIPTION

The description and claims herein are directed to a method and apparatus to perform date-time conversions and complex date-time calculations between dates of different calendaring systems. A date-time of a first format is converted to any other date-time of another format after a transformation to a temporal reference or epoch date.

Figure 1:
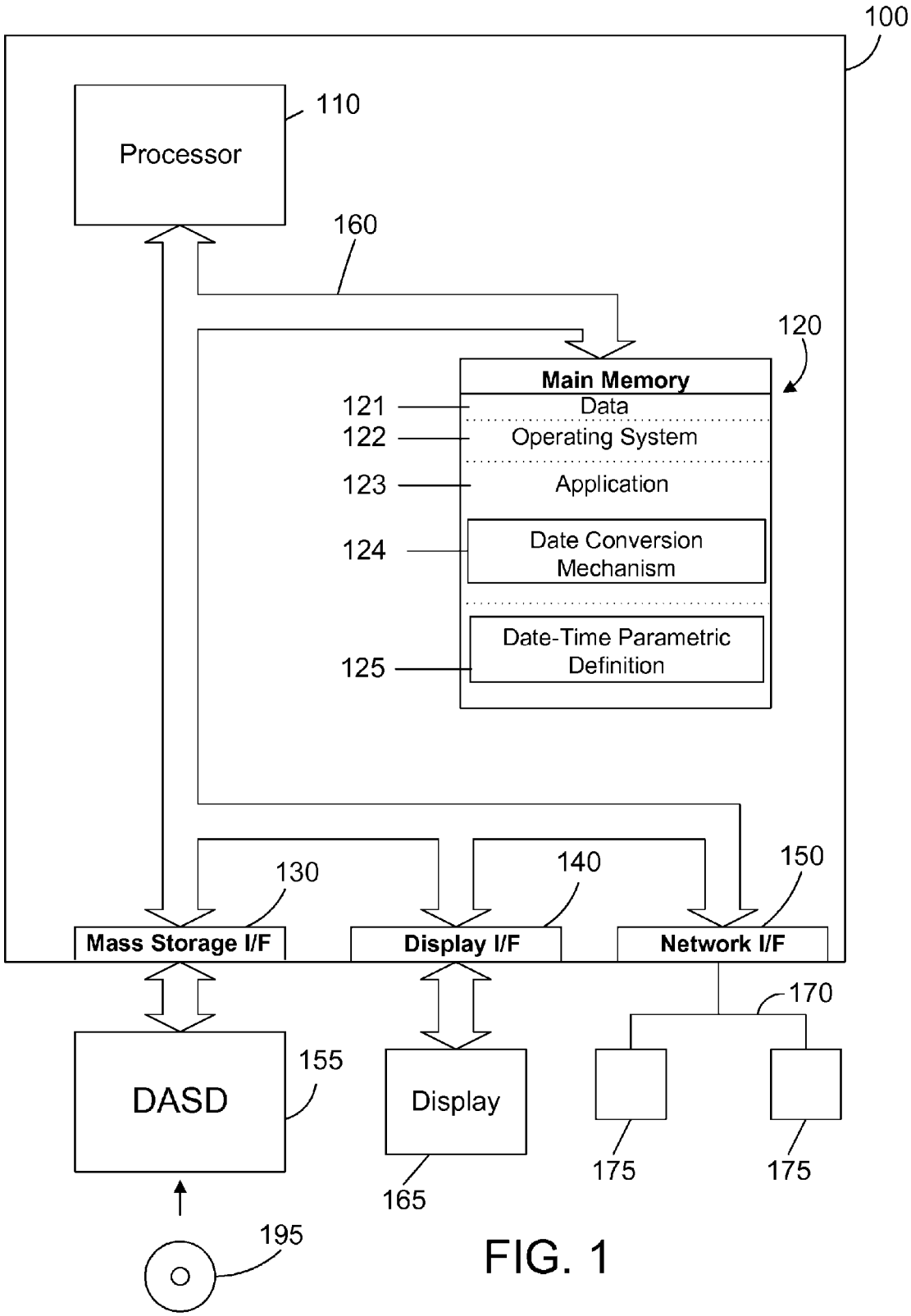
FIG. 1 is a block diagram of a computer system with a transformation engine for automatically generating dynamic documentation from a product's configuration related data.

Referring to FIG. 1, a computer system 100 is one suitable implementation of the apparatus and method described herein. Computer system 100 is an IBM System i computer system. However, those skilled in the art will appreciate that the methods and apparatus described herein apply equally to any computer system, regardless of whether the computer system is a complicated multi-user computing apparatus, a single user workstation, or an embedded control system. As shown in FIG. 1, computer system 100 comprises one or more processors 110, a main memory 120, a mass storage interface 130, a display interface 140, and a network interface 150. These system managers are interconnected through the use of a system bus 160. Mass storage interface 130 is used to connect mass storage devices, such as a direct access storage device 155, to computer system 100. One specific type of direct access storage device 155 is a readable and writable CD-RW drive, which may store data to and read data from a CD-RW 195.

Main memory 120 contains data 121, an operating system 122, an application 123 with a date conversion mechanism 124, and a date-time parametric definition 125. Data 121 represents any data that serves as input to or output from any program in computer system 100. Operating system 122 is a multitasking operating system known in the industry as i5/OS; however, those skilled in the art will appreciate that the spirit and scope of this disclosure and claims are not limited to any one operating system.

Computer system 100 utilizes well known virtual addressing mechanisms that allow the programs of computer system 100 to behave as if they only have access to a large, single storage entity instead of access to multiple, smaller storage entities such as main memory 120 and DASD device 155. Therefore, while data 121, operating system 122, application 123, date conversion mechanism 124, and a date-time parametric definition 125 are shown to reside in main memory 120, those skilled in the art will recognize that these items are not necessarily all completely contained in main memory 120 at the same time. It should also be noted that the term "memory" is used herein generically to refer to the entire virtual memory of computer system 100, and may include the virtual memory of other computer systems coupled to computer system 100.

Processor 110 may be constructed from one or more microprocessors and/or integrated circuits. Processor 110 executes program instructions stored in main memory 120. Main memory 120 stores programs and data that processor 110 may access. When computer system 100 starts up, processor 110 initially executes the program instructions that make up operating system 122. Although computer system 100 is shown to contain only a single processor and a single system bus, those skilled in the art will appreciate that the improved transformation engine described herein may be practiced using a computer system that has multiple processors and/or multiple buses.

Display interface 140 is used to directly connect one or more displays 165 to computer system 100. These displays 165, which may be non-intelligent (i.e., dumb) terminals or fully programmable workstations, are used to allow system administrators and users to communicate with computer system 100. Note, however, that while display interface 140 is provided to support communication with one or more displays 165, computer system 100 does not necessarily require a display 165, because all needed interaction with users and other processes may occur via network interface 150.

Network interface 150 is used to connect other computer systems and/or workstations (e.g., 175 in FIG. 1) to computer system 100 across a network 170. The date conversion mechanism described herein applies equally no matter how computer system 100 may be connected to other computer systems and/or workstations, regardless of whether the network connection 170 is made using present-day analog and/or digital techniques or via some networking mechanism of the future. In addition, many different network protocols can be used to implement a network. These protocols are specialized computer programs that allow computers to communicate across network 170. TCP/IP (Transmission Control Protocol/Internet Protocol) is an example of a suitable network protocol.

At this point, it is important to note that while the date conversion mechanism has been and will continue to be described in the context of a fully functional computer system, those skilled in the art will appreciate that the date conversion mechanism described herein is capable of being distributed as an article of manufacture in a variety of forms, and that the claims extend to all types of computer-readable media used to actually carry out the distribution. Examples of suitable computer-readable media include: recordable media such as floppy disks and CD-RW (e.g., 195 of FIG. 1).

As used herein, a "date-time" represents a specific date and time expressed in a format for a specific calendar system. The date-time conversion method uses a date-time parametric definition to calculate an offset from epoch date or determine a date from an epoch offset. The date-time parametric definition includes parameters needed to create a conversion for a given calendar system as described below. As used herein, a date in a date-time format is made up of base units and derived units. The base units are periods of fixed lengths of time, and the derived units are constructs of the base units. The derived units may include seasonal-astronomical constructs' which are factors to increase the accuracy of the date-time format relative to observed seasonal or astronomical events. Each base unit is a period of fixed length so it can be treated as a fixed unit of time, with a set function to convert it into an offset, in the smallest common unit of time (usually milliseconds) from an arbitrarily defined 'Universal Epoch Start Point'. With date-time formats defined in this way, the date conversion mechanism translates a date from any date-time format using a parametric definition to an offset value from the epoch start point. Once converted, any requested mathematical operation can be performed upon the universal values. The universal result can then be translated back to a date in any number of required date-time formats with another parametric definition.

For each date-time format, corresponding to a calendar system, the date conversion mechanism creates or uses an existing date-time parametric definition. Each parametric definition includes the following parameters to define the calendar system:

- Length of each fixed period of time
- Value and period of application for any cyclical leap-time correction factor, or correction factor for any non-cyclical constructs.
- Value of the (arbitrary, but constant) universal epoch start point for this calendar.

The date-time conversion method described herein can be embodied in an extensible software routine which may be embedded in any application for real time conversion between date-time formats of different calendaring systems. The method treats calendrical variations and calendrical units as a hierarchy of 'universal groupings of time', with added plug-in 'extensions' to take care of any cyclical or non-cyclical induced variations. In this way, the method is extensible, such that any calendar or arbitrary calendar variation may be instantiated via the input of new values to create a new date-time parametric definition to describe the new date-time format for a new calendar system.

A method herein provides conversion from a date of a first date-time format to a date of any other date-time format after a transformation to a temporal reference or epoch date. The method inputs a date with a date-time format and a desired output date-time format. If the parametric definitions of both of these date-time formats are available, then the input date is transformed with the parametric definition, any calculations are performed, and then the date is converted to the desired output date-time format with the corresponding parametric definition. If the parametric definitions for date-time of the input date or the desired date are not available, the method inputs from the user the necessary calendar parameters to create the parametric definition for the missing calendar system. An input date is converted into an offset from an arbitrary universal epoch start point, expressed in the same basic unit of time, referenced to the calendar in question. Calculations can be performed upon the offsets and then the results, expressed in Offsets from the epoch start point, is converted to any desired date-time format specified. The conversion is done by reconverting to even increments of definable period or length, stripping the remainder, and applying factors to restore any cyclical or non-cyclical induced variations. This method is described further below with reference to FIG. 2.

As mentioned above, the method described herein includes performing calculations upon the results of converting an input date into an offset from a universal epoch start point. For example, such calculations could be adding or subtracting some amount of time to the offset before changing the offset to the desired calendar system. A second example could be to add a difference between two dates to the offset. In this example, two dates would need to be input for conversion to offsets, then the difference between the offsets determined. The difference could then be added or subtracted from a date offset before converting to the desired output calendar system. Thus while the method is described with the simple case of a single input date, in some cases the input may require multiple dates for the step of performing requested calculations.

Figure 2:
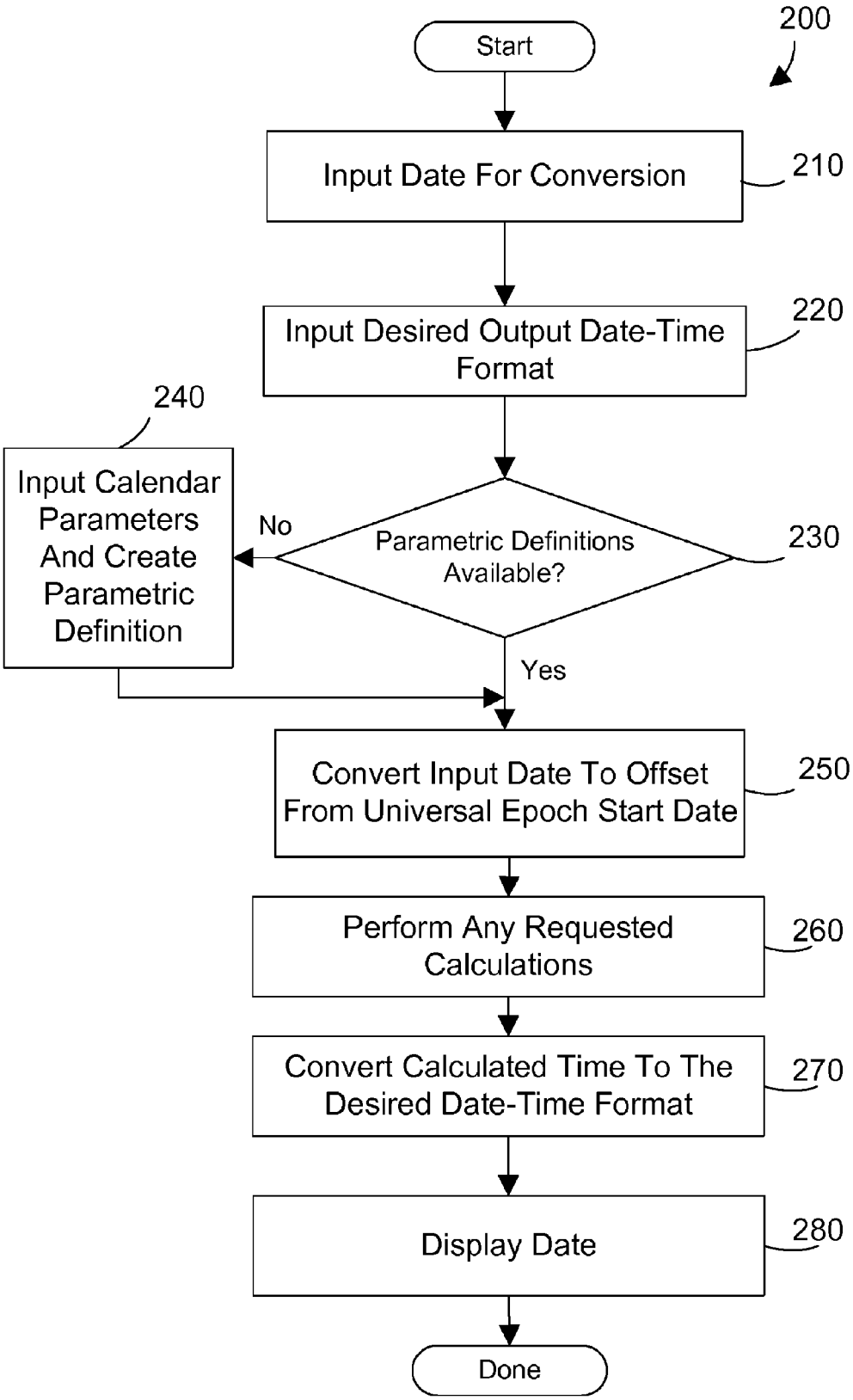
FIG. 2 is a method flow diagram for converting a date from a first calendar system to a second calendar system.

FIG. 2 shows a method 200 for real-time conversion of a date in a first date-time format to a second date-time format. The steps in method 200 are typically performed by a conversion mechanism in a computer system as described above. First, input a date for conversion (step 210). Next, input a desired output date-time format corresponding to a calendar system (step 220). If the parametric definitions for the two date-time formats are not available (step 230=no), then input the calendar parameters and create a parametric definition (step 240). If the parametric definitions for the two date-time formats are available (step 230=yes), then convert the input date to an offset from a universal epoch start date (step 250). Perform any requested calculations (step 260), and then convert the calculated result to the desired date-time format (step 270). Finally, output the converted date by displaying the date, transmitting the date external to the computer system, or use the converted date for other operations in a database or software application (step 280). The method is then done.

Figure 3:
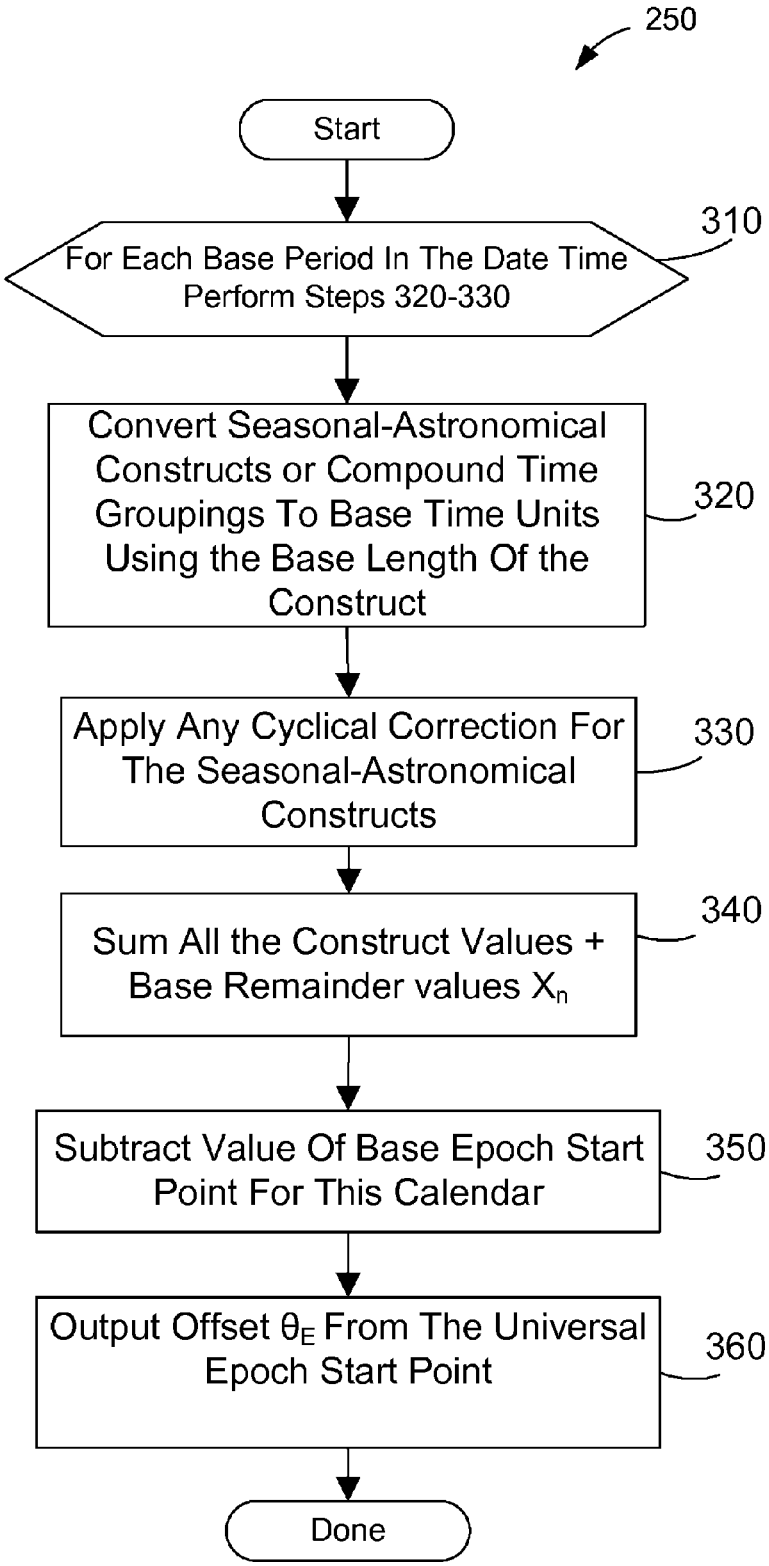
FIG. 3 is a method flow diagram that illustrates one possible implementation of step 250 in FIG. 2.

FIG. 3 is a method flow diagram 250 that illustrates one possible implementation of step 250 in FIG. 2 to convert an input date-time to an offset from a universal epoch start date. The method 250 uses the input date for conversion obtained in step 210. For each base period in the input date-time, repeat steps 320 and 330 (step 310). Convert any seasonal-astronomical constructs or compound time groupings to base time units of the lowest base using the base length of the construct (step 320). Apply any cyclical corrections for the seasonal astronomical constructs (step 330). Then sum all the construct values plus the base remainder values for each base $X_n$ (step 340). Subtract the value of the base epoch start point for this calendar (step 350). Then output the offset $\theta_E$ from the epoch start point (step 360). The method is then done.

Figure 4:
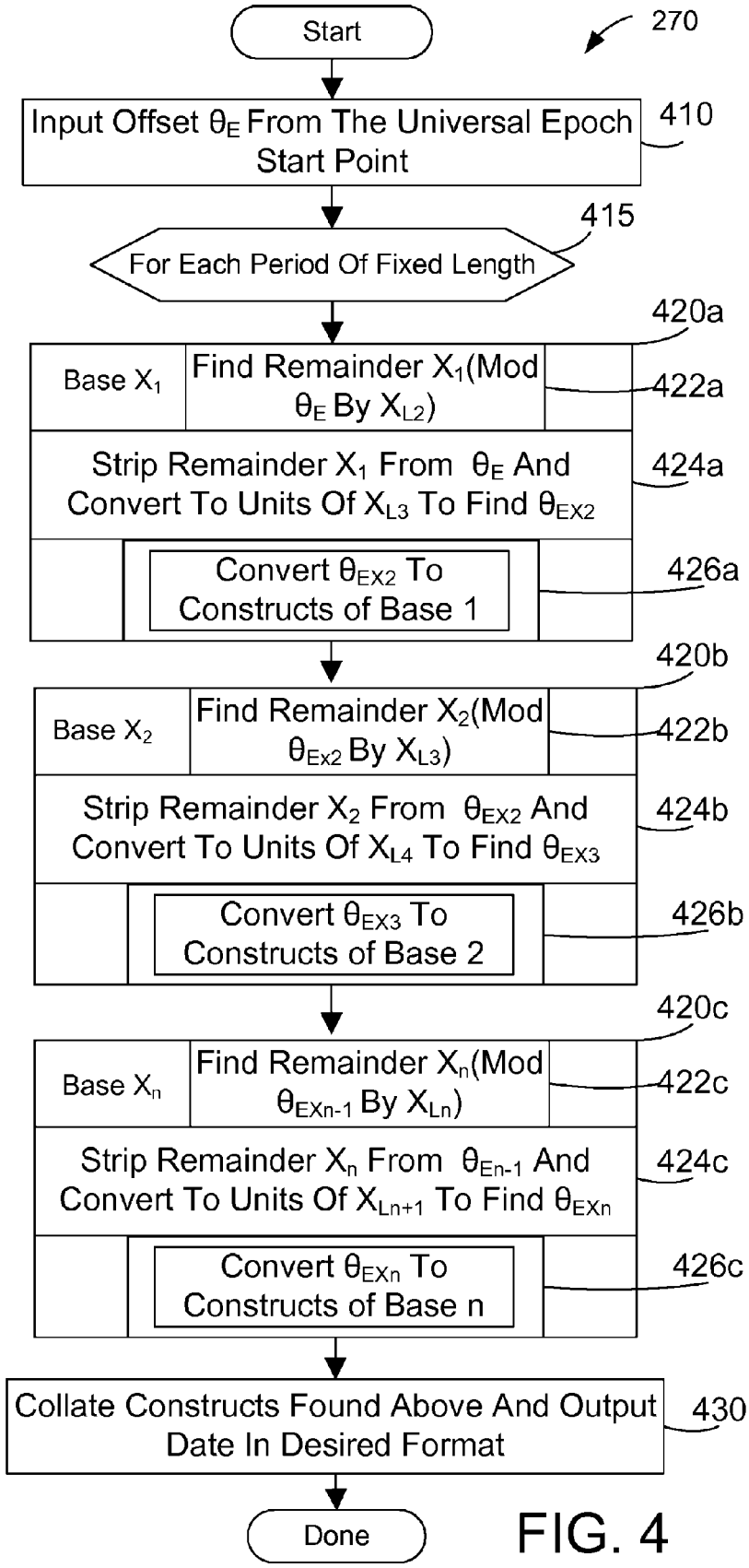
FIG. 4 is a method flow diagram that illustrates one possible implementation of step 270 in FIG. 2.

FIG. 4 is a method flow diagram that illustrates one possible implementation of step 270 in FIG. 2 to convert an offset $\theta_E$ from a universal epoch start point that may be a calculated value if a calculation was done. The offset $\theta_E$ is input for conversion (step 410). For each base period of fixed length in the calendar format, repeat the steps to convert the offset to find the base period in the desired calendar (step 415). The repeat of the steps is shown as steps 420*a*, 420*b* and 420*c*, but could be any number of steps depending on the number of base periods of fixed length. The repeat of the same step is shown as multiple steps to illustrate the relationship of the values between the steps. To process the periods of fixed length, first find the remainder $X_1$ (Mod $\theta_{E1}$ by $X_{L2}$) (step 422*a*). Strip the remainder $X_1$ from $\theta_E$ and convert to units of $X_{L3}$ to find $\theta_{EX2}$ (step 424*a*). Convert $\theta_{EX2}$ to constructs of Base 1 (step 426*a*). Next, repeat to find the remainder $X_2$ (Mod $\theta_{E2}$ by $X_{L3}$) (step 422*b*). Strip the remainder $X_2$ from $\theta_{EX2}$ and convert to units of $X_{L4}$ to find $\theta_{EX3}$ (step 424*b*). Convert $\theta_{EX3}$ to constructs of Base 2 (step 426*b*). The next time we show the last time for this step with generic case "n". Find the remainder $X_n$ (Mod $\theta_{EXn-1}$, by $X_{Ln}$) (step 422*c*). Strip the remainder $X_n$ from $\theta_{En-1}$ and convert to units of $X_{Ln+1}$ to find $\theta_{EXn}$ (step 424*a*). Convert $\theta_{Exn}$ to constructs of Base n (step 426*c*). Finally, collate the constructs found in the above steps and output a date in the desired date-time format (step 430). The method is then done.

Figure 5:
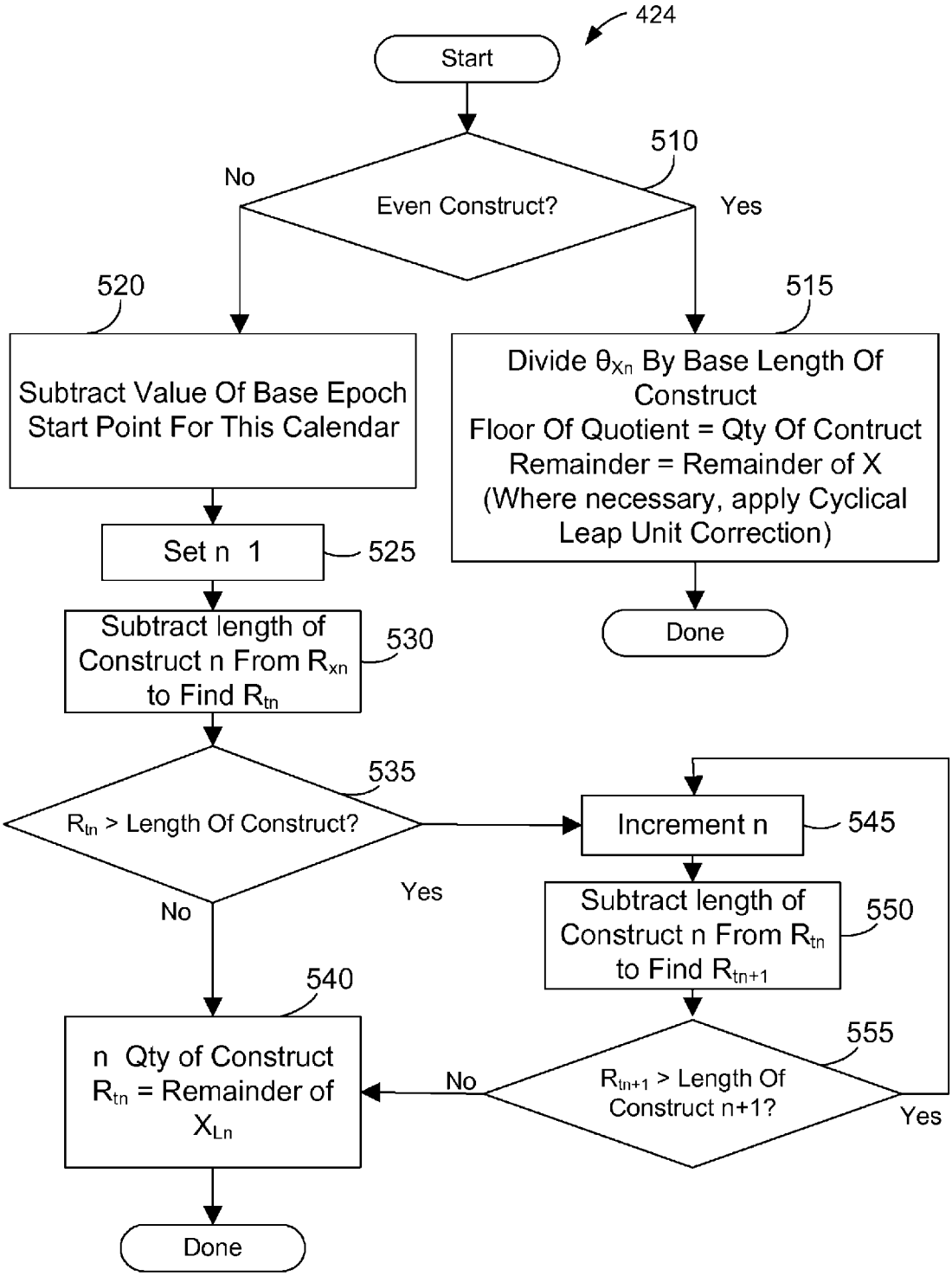
FIG. 5 is a method flow diagram that illustrates one possible implementation of step 424 in FIG. 4.

FIG. 5 is a method flow diagram that illustrates one possible implementation of step 424 in FIG. 4 to convert the offset from the epoch in the current base. This flow is repeated for each base with a fixed length period. First determine if the construct for the current base is an even construct, meaning the construct has even length intervals such as a week (step 510). If the construct is an even construct (step 510=yes) then divide number of units for the current base ($\theta_{Exn}$) by the base length of the construct to find the quantity of the construct, the remainder of the construct, while applying cyclical leap unit corrections where necessary (step 515). The method is then done for even constructs. If the construct is not an even construct (step 510=no) then subtract the value of the base epoch start point for this calendar from the number of units for the current base ($\theta_{Exn}$) (step 520). Set a counter n=1 (step 525). Subtract the length of construct n from $R_{Xn}$ to find $R_{tn}$ (step 530). If $R_{tn}$ is greater than the length of the construct (step 535=yes) then increment n (step 545) and subtract the length of construct n from $R_{tn}$ to find $R_{tn+1}$ (step 550). If $R_{tn+1}$ is greater than the length of the construct n+1 (step 555=yes) then return to step 545. If $R_{tn+1}$ is not greater than the length of the construct n+1 (step 555=no) then n now reflects the quantity of the construct and $R_{tn}$ is the remainder of $X_{Ln}$ (step 540). If $R_{tn}$ is greater than the length of the construct (step 535=no) then n now reflects the quantity of the construct and $R_{tn}$ is the remainder of $X_{Ln}$ (step 540). The method is then done.

The methods described above with reference to FIGS. 2 and 3 can be represented in the form of an algorithm expressed with variables. FIG. 6 is a list of variable definitions used in the formulas in subsequent figures. FIG. 7 is a generalized formula for conversion to an offset from a universal epoch 710 from a Gregorian date according to method 250 in FIG. 3. Similarly, FIG. 8 is the same formula shown in FIG. 7 but with the constants and variables substituted as shown in the box 810.

We will now consider the formula shown in FIG. 8. The formula has terms $X_5$ through $X_1$. Each term $X_5$ through $X_1$ provides the value for the conversion of the input date for the corresponding base unit X. The first base unit, $X_1$ is typically mS, $X_2$ is seconds $X_3$ is minutes, $X_4$ is hours and $X_5$ is days. The first parenthesis 812 of term $X_5$ computes the number of days in the input date from the epoch start point for this calendar. The number of days is then multiplied by the factor 814 to convert the days to milliseconds (mS). In the first parenthesis 812 there are 5 sub-terms that convert seasonal-astronomical-constructs (SAC) to days. The first sub-term 816 determines the number of days from the epoch offset for the input date with year "y". The next three sub-terms 818 are cyclical corrections for SAC. In this case, the sub-terms add or subtract days for leap year corrections. The fifth sub-term 820 adjusts the days depending on the month of the input date. The summation in this sub-term 820 adds days for each month past the month of the input date, subtracts a correction $O_5$, and adds the day for the current month $X_5$. The time correction factor $O_5$ corrects for day offset as needed for some calendar systems. The terms $X_4$ through $X_1$ change the fixed length periods all to milliseconds (hours, minutes, and seconds). The final term subtracts the time zone offset from GMT to adjust for the time zone of the input date. All these terms added together provide an offset $\Theta_E$ from an epoch start point for the calendar used for the input date.

FIG. 9 is a formula for conversion to an offset from a universal epoch 710 from a French Republican calendar date according to method 250 in FIG. 3. The formula in FIG. 9 uses the constants and variable definitions as shown in the box 910. The formula in FIG. 9 has the same basic structure and components as described above for FIG. 8.

FIGS. 10-12 illustrate formulas for the methods described above with reference to FIGS. 4 and 5. FIG. 10 is part of a parametric definitions used in the formulas in FIGS. 11 and 12. FIG. 11 is a generalized formula for conversion from an offset from a universal epoch 710 to a Gregorian date according to method 270 in FIG. 4. Similarly, FIG. 12 is the same formula shown in FIG. 11 but with the constants and variables substituted for a Gregorian date.

FIG. 10 represents a portion of the parametric definition for the Gregorian calendar. FIG. 10 illustrates the cyclical leap-time correction factors 1010. The parametric definition also includes the time base lengths $X_{L1}$ through $X_{L4}$ and the epoch start point (not shown in FIG. 10). For example, an epoch start point for the ISO 8601 calendar system is Jan. 1, 1970, 00:00:00:000 (hours:minutes:seconds:miliseconds). The cyclical leap-time correction factors 1010 include a factor Z for each time period A through D. Correction Factor $Z_{perA}$ corrects for 4000 year variations, $Z_{perB}$ corrects for 400 year variations, $Z_{perC}$ corrects for 100 year variations, $Z_{perD}$ corrects for 4 year variations.

We will now consider the formulas shown in FIGS. 11 and 12. There are five calendar terms $CX_1$ through $CX_4$ where each of these terms is generated by step 420 in FIG. 4. The $CX_1$ term 1110 has a remainder term $R_{X1}$ and an offset from epoch term $\theta_{EX2}$. The other calendar terms are similar but correspond to a different base unit of time as shown in FIG. 12. When the $CX_1$ through $CX_3$ terms are created by the method in FIG. 4, the step to convert the $\theta_{EX}$ term to the constructs of the base (step 426) is a null case for the typical case such as the Gregorian calendar as shown here. The null case means there are no constructs for these time bases in the Gregorian calendar. However, for the $CX_4$ term, there are constructs for the base $\theta_{EX5}$, also called $\theta_{ED}$ since it is days in most cases. The constructs for the Gregorian calendar are weeks, months and years. These constructs can be generated as described in method 424 in FIG. 5 depending on whether they are even or odd length constructs. In this example, the year for the input date is calculated as a construct of the number of days $\theta_{ED}$ using the cyclic correction factors. In the year definition 1120, the denominator 1125 is the average length of a year over the time period of the input offset $\theta_E$. Similarly, the days remainder 1130 is a construct of the number of days in the current year for the input offset $\theta_E$.

One skilled in the art will appreciate that many variations are possible within the scope of the claims. Thus, while the disclosure has been particularly shown and described above, it will be understood by those skilled in the art that these and other changes in form and details may be made therein without departing from the spirit and scope of the claims.

The invention claimed is:

1. A system comprising:

a computer processor and a memory;

a date conversion mechanism that performs a method of converting the data from a first calendar system to a second calendar system, the method comprising:

a) loading a first parametric definition for a first calendar;

b) loading a second parametric definition for a second calendar;

c) receiving a date specified according to the first calendar;

d) using the first parametric definition to transform the date into a corresponding temporal reference;

e) using the second parametric definition to transform the temporal reference into a date specified according to the second calendar; and f) outputting the date specified according to the second calendar.

2. The system of claim 1, wherein the date comprises at least one base unit and at lease one seasonal-astronomical construct of the base unit.

3. The system of claim 1, wherein the first parametric definition comprises:

a length of each time period;

a value and a period of application for any cyclical leap-time correction factor;

a correction factor for any non-cyclical constructs; and a universal epoch start point for the calendar.

4. The system of claim 1, wherein the date conversion mechanism is a program stored in the memory which, when executed by the computer processor performs the steps of claim 1.

5. The system of claim 1, wherein the date conversion mechanism further performs the step of performing calculations on the temporal reference before using the second parametric definition to transform the temporal reference into a date specified according to the second calendar.

6. The system of claim 1, wherein the step of loading the second parametric definition includes inputting calendar parameters from a user and creating the second parametric definition to transform the temporal reference into a date specified according to the second calendar.

7. The system of claim 6, wherein the second parametric definition comprises:

a length of each time period;

a value and a period of application for any cyclical leap-time correction factor;

a correction factor for any non-cyclical constructs; and a universal epoch start point for the calendar.

8. A computer-implemented method of converting a date from a first calendar to a second calendar system comprising the steps of:

a) loading a first parametric definition for a first calendar;

b) loading a second parametric definition for a second calendar;

c) receiving a date specified according to the first calendar;

d) using the first parametric definition to transform the date into a corresponding temporal reference;

e) using the second parametric definition to transform the temporal reference into a date specified according to the second calendar;

f) outputting the date specified according to the second calendar.

9. The method of claim 8, wherein the date comprises a base unit and a task construct.

10. The method of claim 8, wherein the first parametric definition comprises:

a length of each time period;

a value and a period of application for any cyclical leap-time correction factor;

a correction factor for any non-cyclical constructs; and a universal epoch start point for the calendar.

11. The method of claim 8, wherein the date conversion mechanism further performs the step of performing calculations on the temporal reference before using the second parametric definition to transform the temporal reference into a date specified according to the second calendar.

12. The method of claim 8, wherein the step of loading the second parametric definition includes inputting calendar parameters from a user and creating the second parametric definition to transform the temporal reference into a date specified according to the second calendar.

13. The method of claim 12, wherein the second parametric definition comprises:

a length of each time period;

a value and a period of application for any cyclical leap-time correction factor;

a correction factor for any non-cyclical constructs; and a universal epoch start point for the calendar.

14. A computer-readable article of manufacture comprising:

a program which, when executed by a processor, causes a computing device to perform a method of converting a date from a first calendar system to a second calendar system, the method comprising the steps of:

a) creating a first parametric definition for a first calendar;

b) creating a first parametric definition for a first calendar;

c) receiving a date specified according to the first calendar;

d) using the first parametric definition to transform the date into a corresponding temporal reference; and e) using the second parametric definition to transform the temporal reference into a date specified according to the second calendar; and tangible computer recordable media bearing the program.

15. The article of manufacture of claim 14 wherein the date comprises a base unit and a task construct.

16. The article of manufacture of claim 14 wherein the first parametric definition comprises:

a length of each time period;

a value and a period of application for any cyclical leap-time correction factor;

a correction factor for any non-cyclical constructs; and a universal epoch start point for the calendar.

17. The article of manufacture of claim 14 further comprising the step of performing calculations on the temporal reference before using the second parametric definition to transform the temporal reference into a date specified according to the second calendar.

18. The article of manufacture of claim 14, wherein the step of loading the second parametric definition includes inputting calendar parameters from a user and creating the second parametric definition to transform the temporal reference into a date specified according to the second calendar.

19. The article of manufacture of claim 18, wherein the second parametric definition comprises:

a length of each time period;

a value and a period of application for any cyclical leap-time correction factor;

a correction factor for any non-cyclical constructs; and a universal epoch start point for the calendar.

* * * * *